US005082392A

United States Patent [19]

Marchese et al.

[11] Patent Number: 5,082,392

[45] Date of Patent: Jan. 21, 1992

[54] MANHOLE COVER LOCK WITH SPRING BIASED LOCKING BARS

[76] Inventors: Tony Marchese, 315 Ojibway Trail, Mississauga, Ontario, Canada, L4Z 3A2; Jim Houghton, 59 Crown Crescent, Bradford, Ontario, Canada, L3Z 2M4; Dick Launspach, R R #8, 36 Victoria Cres, Mono Mills, Orangeville, Ontario, Canada, L9W 3T5; Domenic Marchese, 5 Manswood Cres, Brampton, Ontario, Canada, L6T 3Y7

[21] Appl. No.: 675,680

[22] Filed: Mar. 27, 1991

[51] Int. Cl.[5] ..... E01C 29/14; B65D 55/14

[52] U.S. Cl. ..... 404/25; 70/168

[58] Field of Search ..... 404/25, 26; 70/168–169

[56] References Cited

U.S. PATENT DOCUMENTS

| | | | |
|---|---|---|---|
| 845,185 | 2/1907 | Letts | 70/168 |
| 1,458,391 | 6/1922 | Burton | 404/25 X |
| 1,616,298 | 2/1927 | Arnett | 70/168 |
| 1,986,203 | 11/1933 | Ivandick | 70/168 |
| 3,797,286 | 3/1974 | Saporito | 70/169 |
| 3,901,407 | 8/1975 | Mitchell et al. | 70/169 X |
| 3,973,856 | 8/1976 | Gaglioti | 404/25 |
| 4,461,597 | 7/1984 | Laurin | 404/25 |
| 4,523,407 | 6/1985 | Miller | 404/25 X |
| 4,577;478 | 3/1986 | Economopoulos et al. | 70/168 |
| 4,597,692 | 7/1986 | Gruenwald | 404/25 |
| 4,723,866 | 2/1988 | McCauley | 404/25 |
| 4,902,165 | 2/1990 | Embree | 404/25 |
| 4,964,755 | 10/1990 | Lewis et al. | 404/25 |

*Primary Examiner*—Ramon S. Britts
*Assistant Examiner*—Nancy P. Connolly

[57] ABSTRACT

A locking manhole cover and key combination of the present invention is in the form of a manhole cover having a lock on its undersurface and a vent hole through the manhole cover. The lock comprises a plurality of locking bars spring biased to a locking position, a rotatable actuator accessible through the vent hole for moving the locking bars to an unlocking position with the key being fittable through the vent hole to operate the actuator. The key itself includes a first shaft portion turnable in the vent hole for rotating the acutator and pulling the locking bars to the unlocking position and a second shaft portion which when located in the vent hole prevents rotation of the actuator and holds the spring biased locking bars away from the locking position.

6 Claims, 3 Drawing Sheets

MANHOLE COVER LOCK WITH SPRING BIASED LOCKING BARS

FIELD OF THE INVENTION

The present invention relates to a vented lockable manhole cover where the lock on the cover does not affect the vent through the cover.

BACKGROUND OF THE INVENTION

It is important that manhole covers be locked in position for a number of different reasons. For example, without being locked in position manhole covers can become dislodged simply by vibrations in the road surface to which they are fitted. Also, they are subject to vandalism and theft.

Conventional manhole covers include vent holes which allow unauthorized prying of the covers from the manhole frame. In some instances, young children after removing a manhole cover have climbed down into the sewer system below where they have been caught up in fast flowing water and drowned. Also, the opening of the manhole covers allow unauthorized persons to have undesirable access to the sewer system.

There are presently in use several different manhole locking devices. One design is a J-bolt which goes through the existing manhole hole and bolts the frame to the cover. Another design is in the form of a water tight cover which again bolts the manhole to the frame.

In both of the arrangements described immediately above, the manhole cover is sealed and therefore does not allow the upward escape of gases past the manhole cover. This can and has resulted in explosions within the sewer system beneath the manhole cover.

In addition to being unsafe, the presently used techniques for locking a manhole cover in position are very labour intensive with respect to removing the covers for maintenance and/or inspections.

Other locking systems for manhole covers have been proposed in prior art patents. Such proposals are shown for example in U.S. Pat. Nos. 3,921,494, 3,772,828, 4,577,478, 4,964,755, 4,902,165, and 2,363,567.

The problem with the structures described in the patents noted immediately above, is that they are not self locking and therefore are subject to human error, i.e. even an authorized person opening the cover could well inadvertently forget to lock the cover.

The cover plate in U.S. Pat. No. 2,363,567 does show gravity operation of a lock bar on a manhole cover for moving the lock bar to a locking position. However admitted in the patent, gravity is not sufficient to ensure proper locking of the bars and therefore a locking key is additionally provided to move the bars to a locking position. The gravity operation of the bars requires that they not only move in and out but also up and down making them relatively loose fitting and complicated in their operation.

SUMMARY OF THE PRESENT INVENTION

The present invention provides a very simple yet efficient locking manhole cover and key combination. The manhole cover includes a lock on its undersurface and a vent hole through the manhole cover which is not blocked by the lock. The lock itself comprises a plurality of locking bars which are spring biased to a locking position, a rotatable actuator accessible through the vent hole for moving the locking bars to an unlocking position with the key being fittable through the vent hole to operate the actuator.

The key includes a first shaft portion which is turnable in the vent hole for rotating the actuator and pulling the locking bars to the unlocking position and a second shaft portion which when located in the vent hole, prevents rotation of the actuator and holds the spring biased locking bars away from the locking position.

In order to remove the key from the vent hole, it must be released from the actuator with the locking bars then automatically springing back to their locking position.

BRIEF DESCRIPTION OF THE DRAWINGS

The above as well as other advantages and features of the present invention will be described in the detailed description according to the preferred embodiments of the present invention in which.

DETAILED DESCRIPTION ACCORDING TO THE PREFERRED EMBODIMENTS OF THE PRESENT INVENTION

Figure 1:
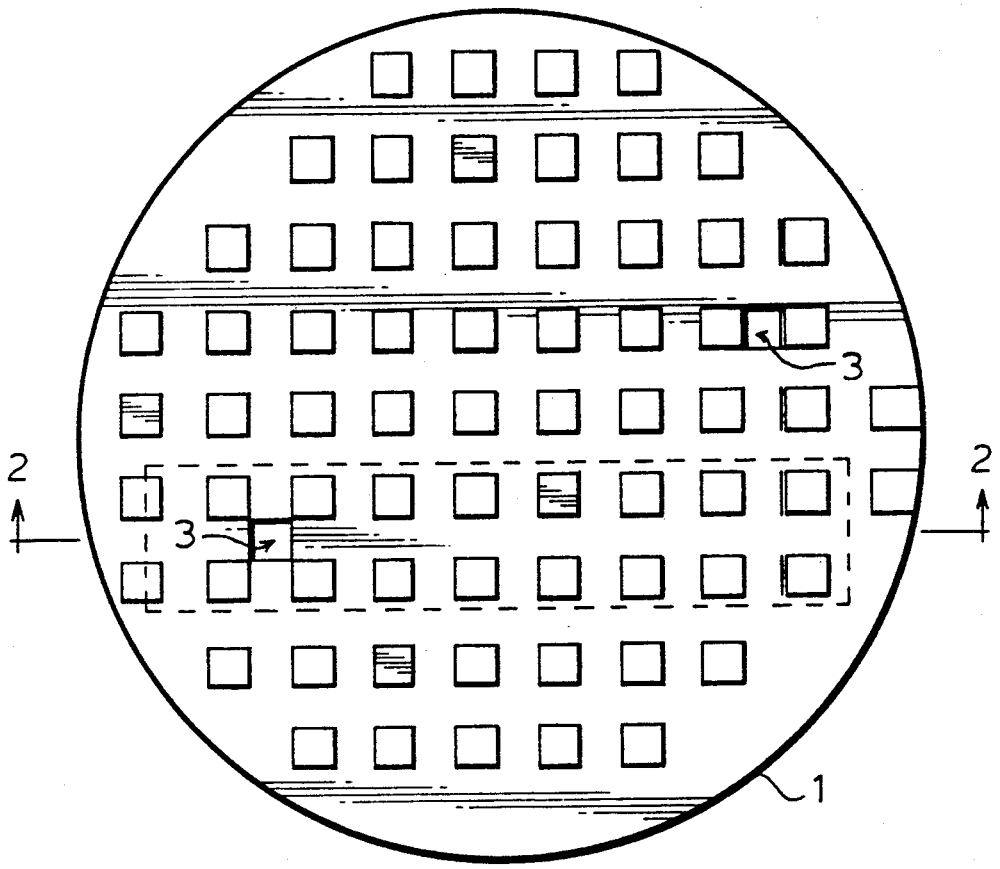
FIG. 1 is a top view of a manhole cover in accordance with the present invention.

FIG. 1 shows a manhole cover 1. This manhole cover when seen from above appears to have a standard construction including a combination vent and lift hole 3.

Figure 2:
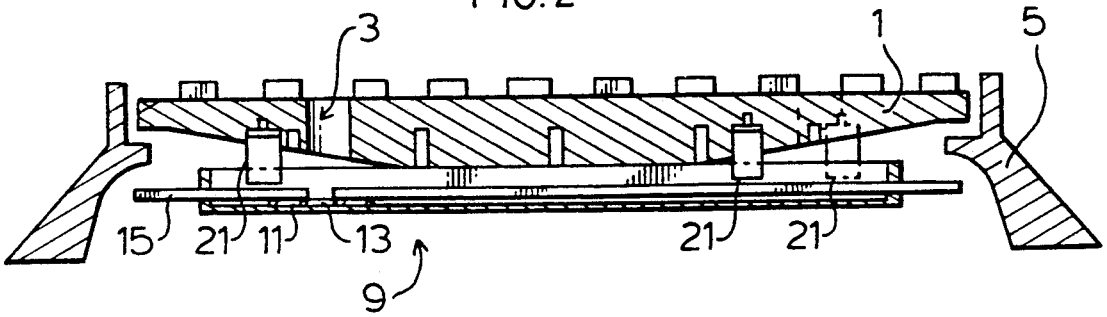
FIG. 2 is a sectional view along the lines 2—2 of FIG. 1.

FIG. 2 shows a sectional view through the manhole cover 1 as fitted to a manhole support 5. This manhole support includes an inwardly extending lip or ledge on which the manhole cover rests. The lip is additionally used to lock the manhole cover in position by a lock generally indicated at 9 on the undersurface of the manhole cover.

Figure 3:
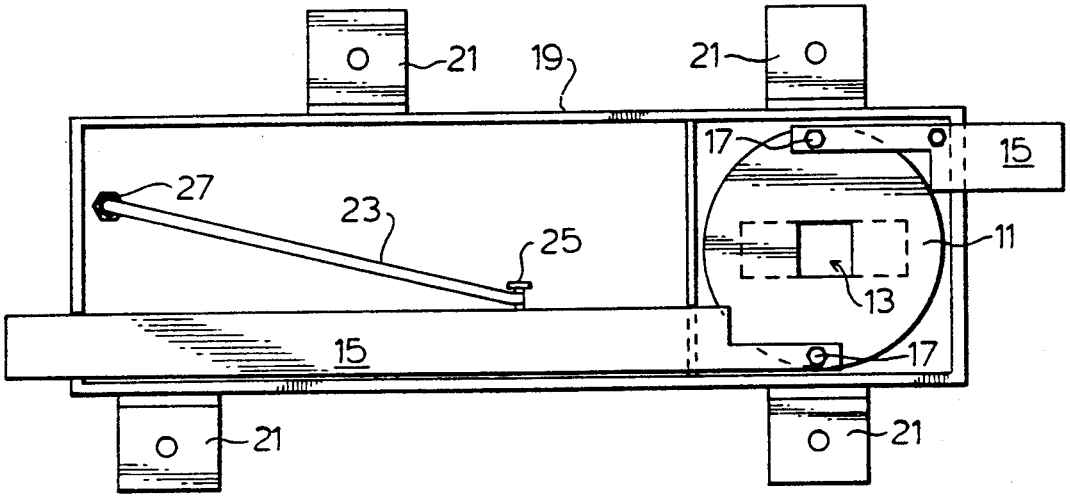
FIG. 3 is a plan view of the lock secured to the underside of the manhole cover in FIG. 1.
Figure 4:
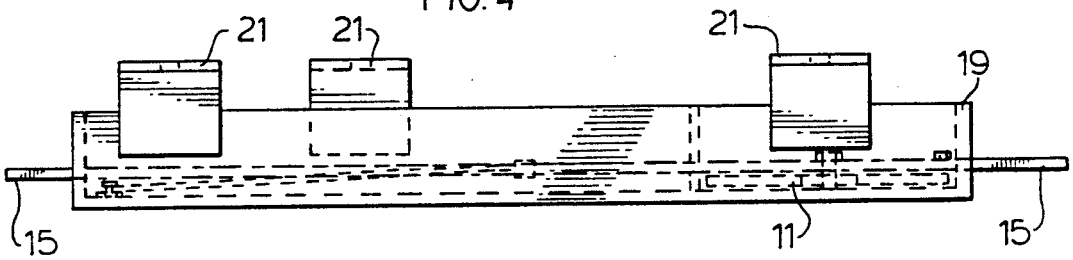
FIG. 4 is a side view of the lock of FIG. 3.
Figure 5:
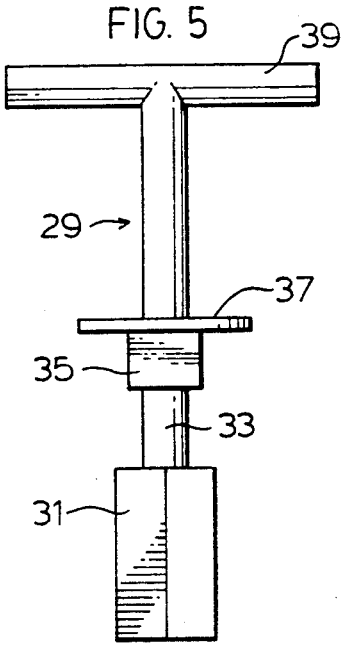
FIG. 5 is a side view of the operating key used for unlocking the lock of FIGS. 3 and 4.

Lock 9 which is better shown in FIGS. 3 and 4 of the drawings includes a mounting frame 19 having a plurality of attachment legs 21 which bolt directly to the cover. Supported by the frame are a pair of movable locking bars 15, the movement of which is guided by frame 19.

The locking bars are pivotally secured to a rotatable disk actuator or control member 11. Actuator 11 is provided with a centrally located key opening 13. Typically key opening 13 has a square shape which matches the shape of the lift or vent hole.

When the lock is mounted to the undersurface of the manhole cover key opening 13 is aligned directly beneath the vent hole through the cover. This allows a key, generally indicated at 29 to be fitted down through the vent hole to operate actuator 11.

Also provided in the lock is a spring 23 secured at 25 to one of the locking arms 15 and at 27 to the frame 19. This spring normally biases both of the locking bars to a locking position as shown in FIG. 2 of the drawings where the locking bars project outwardly of the frame beneath lip 7 in the manhole frame. The pulling of the spring on one of the locking bars is translated through the freely rotatable actuator 11 to the other of the locking bars so that both locking bars normally assume the locking position as noted above. With the locking bars in the FIG. 2 position, the manhole cover cannot be lifted out of position from the manhole frame.

Figure 4A:
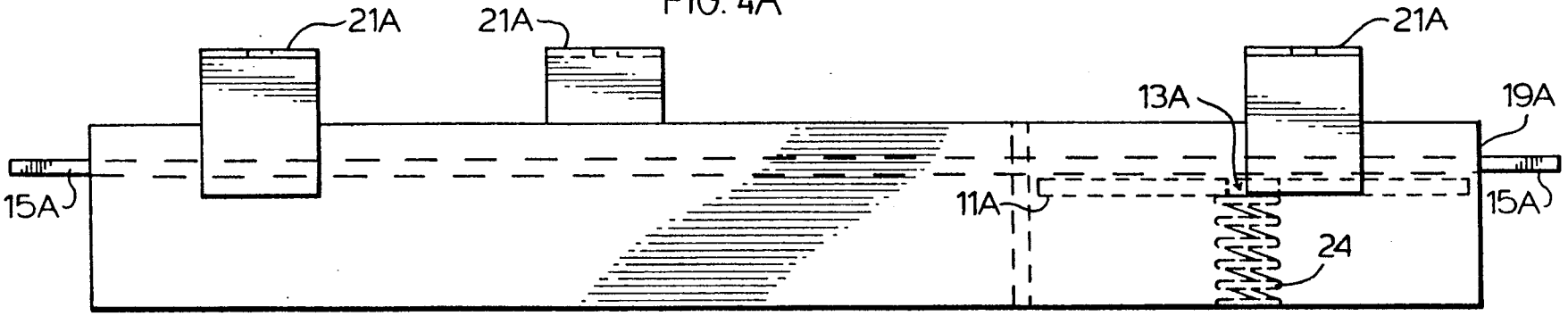
FIG. 4A is a side view of a somewhat modified lock according to a further preferred embodiment of the present invention.

FIG. 4A shows a lock slightly modified from the lock described above with respect to FIGS. 3 and 4. Consistent with the earlier embodiment, the lock shown in FIG. 4A includes an actuator plate 11*a* which controls a pair of movable locking arms 15*a*. These arms are guided by frame 19*a* of the lock which additionally includes mounting legs 21*a* to mount the lock to the bottom side of the manhole cover.

The lock shown in FIG. 4A includes a coil spring 24 mounted to the frame and also secured to actuator plate 11*a* to hold the actuator plate and the locking arms in a locked position as earlier described. The actuator plate, although not seen from above, has the identical configuration and connections to the movable locking arms as that shown in FIG. 3. The method of rotating actuator plate 11*a* is also the same as the method of rotating actuator plate 11 to be described later in detail.

Key 29 is used to rotate actuator 11 and move bars 15 to an unlocking position against the bias of spring 23. This key has an elongated shaft comprising different shaft portions 31, 33, and 35. A rounded stop 37 is provided above shaft portion 35 and an upper handle 39 is used to rotate the key.

Figure 6:
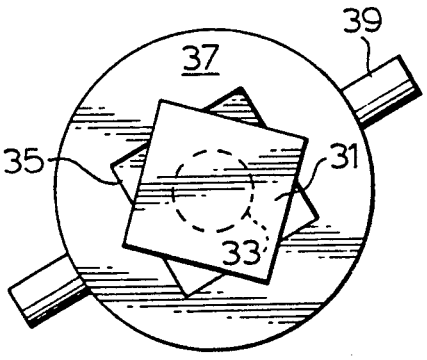
FIG. 6 is a bottom plan view of the key shown in FIG. 5.

As best seen in FIG. 6 of the drawings the bottom shaft portion is of the key has a square configuration matching that of key opening 13 in actuator 11. Shaft portion 31 also matches the shape of the lift hole allowing it to pass through the manhole cover to gain access to the actuator. The key is pushed sufficiently far down through the manhole cover so that the smaller diameter rounded portion 33 of the key is located at the vent hole with shaft portion 31 in the key opening 13 of actuator 11. In this position the key can be rotated within the cover lift hole. This in turn rotates the actuator to pull arms 15 to the unlocking position.

As a result of the spring bias on the arms, if the key was released in this position, the arms would simply spring back to their locking position. This would then necessitate holding the key in the unlocked position while at the same time lifting on the manhole cover. However, this problem is avoided by the provision of shaft portion 35 above shaft portion 33 on the key. As will be seen in FIG. 6 of the drawings, shaft portion 35 again has a square configuration matching that of the vent hole. Shaft portion 35 is located at about 90° relative to shaft portion 31. Therefore, after the key has been turned to rotate actuator 11 to the unlocking position, the key is pushed farther down to lock shaft portion 35 in the lift hole. This prevents rotation of both the key and the actuator and holds arms 15 away from their normally assumed locking position.

Stop 37 prevents the key from being pushed down overly far into the manhole cover so that shaft portion 35 remains nested within the cover hole. Handle 39 is then used to pry the cover off of the manhole frame. Note that the cover does not have to be pulled directly upwardly but rather can be pried out of its position at an angle using the handle 39 on the key. Here it is to be noted that the positioning of the vent hole to one side rather than in the middle of the cover, provides assistance in prying the cover from the frame. After the lock has been released one simply pushes downwardly on the key which, as noted above, will not go farther into the hole because of stop 37. This causes the one side of the cover to effectively fulcrum downwardly so that the other side of the cover pivots upwardly. One can now grip the up side of the cover to pull it from the frame.

In order to get the key back out of the manhole cover, it must be lifted to release shaft portion 35 from the left hole and then returned to a position in which lower shaft portion 31 aligns with the lift hole. In this same position, the actuator 11 is allowed to return to its starting position where the lock bars 15 have once again resumed their locking positions. Therefore, in order to get the key out of the manhole cover, the lock bars must be in the locked position. They will continue to hold this locked position because of the spring bias and can only be pulled away from the locked position by the use of the operating key.

In the FIGS. 3 and 4 embodiment lock, there is, as noted above, a connection of the spring 23 between point 25 on arm 15 and point 27 on the frame of the lock. In the embodiment shown in FIG. 4A, the lower end of spring 24 is connected to frame 19*a* while the upper end of the spring is connected to the actuator plate. In a normal or relaxed condition, spring 24 holds actuator plate 11*a* in the locking position. As the actuator plate is rotated to the unlocking position, the spring is coiled because the one end of the spring is free to rotate with the actuator plate while the other end of the spring is secured to the frame. The spring therefore wants to return the actuator plate to the locking position but is prevented from doing so when shaft portion 35 of key 29 is locked in the vent hole as described above.

The coil spring arrangement shown in FIG. 4A provides a very strong bias on the actuator plate without requiring an overly large spring. Furthermore, the connection of the coil spring is achieved in a very simple yet efficient manner. The tight windings on coil spring 24 are such that it provides a very substantial resistance to even a slight unwinding of the spring and therefore the spring has an essentially unlimited lifespan.

A further feature to be noted through the use of coil spring 24 is that even though it is located directly in line beneath key opening 13*a* in actuator plate 11*a*, the spring has a hollow core and therefore does not block insertion of the key down through the key opening.

Although various preferred embodiments of the invention have been described in detail, it will be appreciated that variations can be made without departing from the spirit of the invention or the scope of the appended claims.

The embodiments of the invention in which an exclusive property or privilege is claimed are defined as follows:

1. A locking manhole cover and key combination, said manhole cover having a lock to the underside thereof and a vent hole through said manhole cover, said lock comprising a plurality of locking bars spring biased by spring means pushing said locking bars outwardly to a locking position, a rotatable actuator accessible through said vent hole for moving said locking bars to an unlocking position with said key being fittable through said vent hole to operate said actuator, and wherein said key includes a first shaft portion turnable in said vent hole for rotating said actuator and pulling said locking bars to the unlocking position and a second shaft portion which locks against turning in said vent hole thereby preventing rotation of said actuator and holding said spring biased locking bars away from said locking position.

2. The combination as claimec in claim 1, wherein said key includes a first shaft portion turnable in said vent hole for rotating said actuator and pulling said locking bars to the unlocking position and a second shaft portion which locks against turning in said vent hole thereby preventing rotation of said actuator and holding said spring biased locking bars away from said locking position.

3. A locking manhole cover and key combination as claimed in claim 1, wherein said vent hole is located off center to one side of said manhole cover, said actuator including a stop to prevent downward movement of said key past said actuator.

4. A locking manhole cover and key combination as claimed in claim 1, wherein said actuator includes a key opening and wherein said key comprises a lower shaft portion with an angled face, a smaller diameter shaft portion above said lower shaft portion and an upper shaft portion with an angled face above said smaller diameter.shaft portion, the angled face on said lower shaft portion being rotationally offset from the angled face on said upper shaft portion.

5. A locking manhole cover as claimed in claim 4, wherein said lower shaft portion is rectangular, said upper shaft portion is rectangular and turned at about 90° relative to said lower shaft portion.

6. A locking manhole cover as claimed in claim 4, wherein said smaller diameter shaft portion is rounded.

* * * * *